United States Patent [19]

Lewis

[11] Patent Number: 4,755,276

[45] Date of Patent: Jul. 5, 1988

[54] NITRO-SUBSTITUTED PITCH AND PROCESS FOR THE PRODUCTION THEREOF

[75] Inventor: Irwin C. Lewis, Strongsville, Ohio

[73] Assignee: Union Carbide Corporation, Danbury, Conn.

[21] Appl. No.: 936,733

[22] Filed: Nov. 17, 1986

Related U.S. Application Data

[63] Continuation of Ser. No. 625,368, Jun. 27, 1984, abandoned.

[51] Int. Cl.[4] ..... C10C 3/02

[52] U.S. Cl. ..... 208/22; 208/44; 568/929; 568/930; 106/273 N; 260/688

[58] Field of Search ..... 568/929, 930, 924; 106/273 N; 208/44, 22; 260/688

[56] References Cited

U.S. PATENT DOCUMENTS 3,140,248 7/1964 Bell et al. ..... 208/40
4,096,056 6/1978 Haywood et al. ..... 208/44

FOREIGN PATENT DOCUMENTS 1015377 9/1957 Fed. Rep. of Germany .
2045798 11/1980 United Kingdom .

OTHER PUBLICATIONS

Karr, Jr., *Analytical Methods for Coal & Coal Products* Academic Press, vol. II, (1978), pp. 496–499, 509-510, 540–541, 548–549.

Hoiberg, *Bituminous Materials*, vol. III, pp. 158, 193, Interscience Publishing (1963).

Ragan et al., "Science and Technology of Graphite Manufacture", J. of Mat. Sci., vol. 18, pp. 3161–3170 (1983).

*Primary Examiner*—John F. Terapane
*Assistant Examiner*—Susan Wolffe
*Attorney, Agent, or Firm*—James L. Sonntag

[57] ABSTRACT

A nitro-substituted pitch demonstrates softening point temperatures in the range of 75°–250° C. and a coking value of at least about 40%. Such pitch is produced by reacting a tar with a nitrating agent at a temperature below 150° C. and above about 0° C.

12 Claims, 1 Drawing Sheet

NITRO-SUBSTITUTED PITCH AND PROCESS FOR THE PRODUCTION THEREOF

This application is a continuation of prior U.S. application Ser. No. 625,368, filing date-6-27-84, now abandoned.

FIELD OF THE INVENTION

The present invention is directed to a novel carbonaceous pitch characterized in that such pitch comprises at least 1 weight percent nitrogen in the form of nitro-functional groups which are bound to the aromatic compound of said pitch. Also provided is a process for the manufacture of such nitro-substituted pitch.

BACKGROUND OF THE INVENTION

Tar-derived pitches have long been employed as binder materials in the production of several carbonaceous materials, such as graphite electrodes, or as precursors for carbon fibers. Although the figures will vary somewhat depending upon the particular product in which the pitch is to be incorporated, in general commercially useful pitches which are to be employed as binder materials should desirably exhibit softening point temperatures in the range of about 100°–200° C. and coking values of about 50–60 weight percent. See, for example, S. Ragan and H. Marsh "Science and Technology of Graphite Manufacture", Journal of Materials Science, Vol. 18, pp. 3161–3170 (1983). Moreover, as is discussed in British Pat. No. 2,045,798 pitches which are to be employed as carbon fiber precursors preferably possess a softening point of 150°–250° C.

As is employed herein the term "softening point temperature" refers to the temperature at which the viscosity of the pitch is reduced to the degree required by the Mettler Softening Point Method of ASTM D 3104-75. The term "coking value" refers to the coke-forming properties of the pitch as measured by the Modified Conractson Test described in C. Karr, Jr., *Analytical Methods for Coal and Coal Products,* Academic Press, Vol. II, p. 521 (1978), ASTM D-189.

In the past, the preparation of pitches exhibiting such desirable properties has generally entailed distillation of the precursor petroleum and coal tars in order to remove the lighter components from these substances, by processes such as that disclosed is U.S. Pat. No. 3,140,248. However, the final pitch yields of such distillation processes are typically relatively low, e.g. about 10–30 weight percent, based upon the weight of the tar starting material. Other processes, such as that disclosed in U.S. Pat. No. 4,096,056 which involves heating the tar precursors while blowing an oxygen containing gas into the reactor, will produce somewhat higher yields but require relatively high temperatures of more than 300° C. and are therefore economically undesirable. Thus it would be desirable to possess a process which would produce high yields of pitch exhibiting useful properties from tar precursors, which process would operate at lower temperatures so as to be more energy efficient.

It is also known in the art that the addition of nitro-functional group-containing aromatic compounds into pitches will increase the coking rate of such pitches. For example, German Pat. No. 1,015,377 shows the addition of aromatic nitro compounds, such as nitroamines, nitrophenols and the like to pitch, while S. Yamada, Kogyo Kapaku Zashi, Chemical Abstracts 58, 4343h, 4344a, b, c, d show the addition of dinitronaphthalene and dinitrobenzene to pitch in order to increase its coking value. It should be noted that pitches are composed primarily of aromatic hydrocarbons and are generally not known to possess functional groups. As stated by A. Hoiberg, *Bituminous Materials,* Vol. III, p. 158, Interscience (1958), "It will be seen then that the compounds positively identified as pitch constituents consist predominantly of condensed polynuclear aromatic hydrocarbons or heterocyclic compounds containing from three to six rings. Methyl and hydroxyl are the only substituent groups encountered and, in a relatively few cases, partial or total saturation of one ring is found." Thus while pitches may contain some small percentage of nitrogen, such nitrogen is generally not present in the form of nitro groups bound to the aromatic rings of which the pitch is composed.

Thus, the above described processes require the additional step of adding and mixing the nitro-substituted aromatic additive to the pitch. Moreover, such nitro-functional group containing aromatic compounds are relatively expensive. It would therefore be desirable to possess a pitch having nitro-functional groups bound to the aromatic constituents of the pitch itself in order to avoid such addition and mixing steps.

British patent application No. 2,045,798 shows a process for preparing a pitch from a tar, which process comprises mixing the tar with a nitrating agent selected from nitric acid, an organic nitrate and nitrogen pentoxide and heating the resulting mixture at a temperature of 150° to 400° C. It is noteworthy however that this patent specifically states that (1) nitro-functional groups and/or nitric ester-functional groups are almost undetected or cannot be detected in the resulting pitch and (2) it is impossible to obtain a pitch having a high softening point (i.e, 150° C. to 250° C.) if the heating temperature during pitch formation is lower than 150° C.

Accordingly, it is an object of this invention to provide a pitch having nitro-functional groups bound to the aromatic component of said pitch.

It is a further object of this invention to provide a pitch having nitro-functional groups bound to its aromatic constituent, which pitch additionally possesses a commercially desirable softening point temperature and coking value.

It is another object of this invention to provide a process for producing pitch from tar in increased yields.

It is yet another object of this invention to provide a process for producing pitch from tar at relatively low temperature and at a relative high rate so as to be more energy efficient. The foregoing and additional objects will become apparent from the following description and examples and the attached figure.

DESCRIPTION OF THE INVENTION

Figure 1:
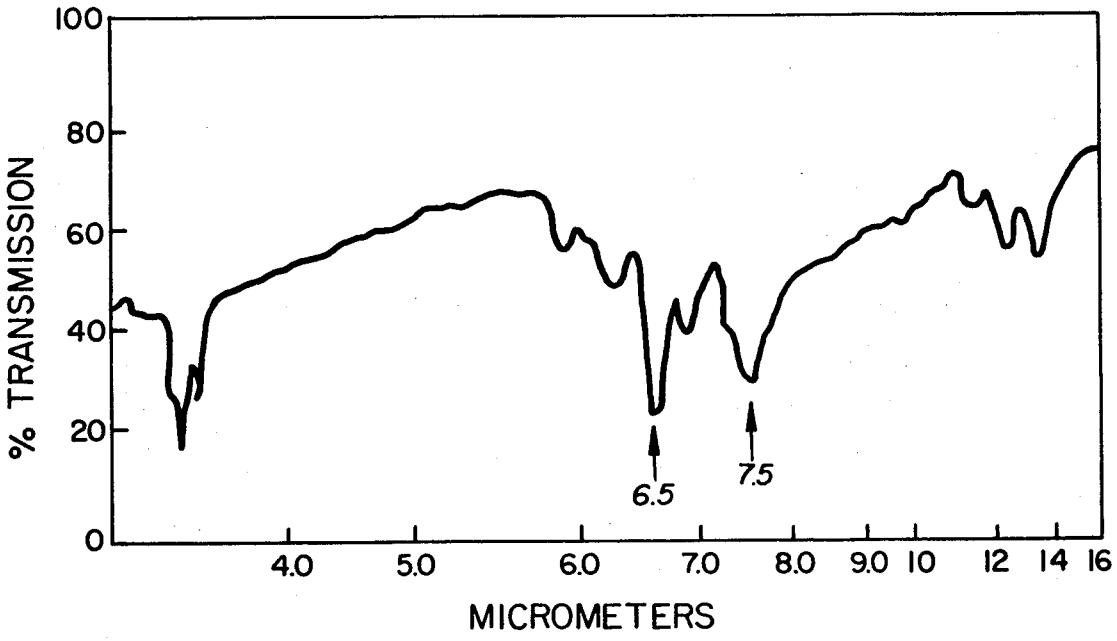
FIG. 1 shows an infrared spectrum of a representative nitro-functional substituted pitch of this invention. Such spectrum possesses peaks at about 6.5 and about 7.5 microns indicating the presence of nitro-functional groups bound to an aromatic constituent.

The present invention relates to a carbonaceous pitch comprised of an aromatic component characterized in that said pitch further comprises at least 1 weight percent nitrogen in the form of nitro-functional groups which are bound to said aromatic component. The nitro-functional groups serve to increase the coking ability of the pitch. Typically the pitch of this invention will possess a softening temperature of between about 75° C. and about 250° C. and coking values of at least about 45 percent and preferably of at least about 60 percent.

In another aspect, this invention relates to a process for the production of a carbonaceous pitch from a tar comprising treating said tar with a nitrating agent at a temperature below 150° C. and above about 0° C. Preferably, such treatment is conducted at a temperature below about 100° C. and most preferably at an ambient temperature of about 25° C., as the use of such lower temperatures will result in energy savings.

The tars which may be employed as the starting material in the process of this invention include aromatic liquid oil or tar products from petroleum and coal refining. Illustrative of such starting materials are pyrolysis tars from ethylene processes, pyrolysis tar distillates, decant oils from catalytic cracking, gas oils from petroleum refining and coking, and coal tars and coal tar distillates. The materials should contain a high concentration of aromatics which are the reactive components to nitration. The presence of alkyl side chains increases reactivity.

Illustrative of the nitrating agents which may be employed in the process of this invention are nitric acid, a mixture of nitric acid and sulfuric acid, anhydrides of nitric acid such as acetyl and benzoyl nitrate, mixtures of alkali nitrates and sulfuric acid, nitric esters such as ethyl nitrate, $N_2O_5$ or $N_2O_4$ with sulfuric acid, $NO_2Cl$, and the like. When nitric acid is employed, it may be utilized in aqueous solutions having concentrations of greater than about 20 weight percent nitric acid. When a mixture of aqueous solutions of nitric acid and sulfuric acid is employed, the nitric acid should be present in concentrations greater than about 25 weight percent and the sulfuric acid should be present in concentrations greater than about 30 weight percent. Preferably, the ratio of nitric acid to sulfuric acid is 2:1 by volume. The preferred nitrating agents are concentrated (e.g. about 70 percent) $HNO_3$ or a mixture of concentrated $HNO_3$ (e.g. about 70 percent) and concentrated (e.g. about 98 percent) $H_2SO_4$.

The process of this invention is typically conducted as follows. The liquid tar precursor is stirring with the nitrating agent (e.g. an aqueous solution of nitric acid) at room temperature. It should be noted that when an aqueous acid solution is employed as the nitrating agent, it is desirable to maintain intimate contact of the tar with the acid (e.g. by stirring or other form of agitation) so that the reaction can occur uniformly. After the desired extent of reaction has been achieved, the solid pitch product can be separated by decantation of the acid or by simple filtration. The process can also be done continuously by spraying the tar precursor feed into the nitric acid solution and continuously separating the more dense product from the bottom of a reactor. The process of this invention may produce yields in excess of 100% based upon the weight of the starting material as a portion of the nitric acid (or other nitrating agent) is incorporated into the pitch produced. The pitch produced is typically dried at a temperature above its melting point in order to drive off residual water. Such drying may be preferably accomplished under air or in a vacuum.

It is preferably to perform the reaction at 25° C. although higher or lower temperatures can be used. Moreover, atmospheric pressure is preferred, but higher or lower pressures may be employed.

In general, both the yield of pitch and the pitch softening point increase with extent of nitration. Thus, care must be taken when producing pitches for use as binders and/or impregnants because of the reaction is too extensive, the product softening temperature will become too high. The extent of nitration can be periodically determined by means well known to these skilled in the art, e.g. by periodic infrared analysis. Similarly, the softening point can be periodically measured, e.g. by periodically employing ASTM D 3104-75 or similar tests. However, the final coke yield of the pitch increases to a maximum during the initial reaction and then decreases with more extensive treatment. The extent of reaction can be controlled by the amount of exposure time to the nitric acid. Pitches with various combinations of properties can be prepared by regulating the extent of nitration. The latter can also be determined by measuring the nitrogen content of the pitch product.

The pitches of this invention comprise at least 1, preferably at least 3, and most preferably at least 4 weight percent nitrogen which is present in the form of nitro-functional groups bound to the aromatic rings comprising said pitch. These features may be determined by elemental analysis for nitrogen coupled with infrared analysis, as nitro-groups bound to aromatic compounds will produce on infrared spectrum having peaks at about 6.5 and 7.5 micrometers.

The pitch of this invention may be employed for any of the uses for which pitches are generally used, such as for carbon fiber precursors, binders and impregnants. Moreover, the pitches of this invention may be blended with commercially available pitches in order to upgrade the coking ability of such commercial pitches.

EXAMPLES

The following Examples are intended to further illustrate the invention and are not intended to limit the scope of this invention in any manner.

Example 1

A decant oil was obtained from the catalytic cracking of gas oil, which decant oil possessed a specific gravity of 1.05, an aromatic proton content of 37% and a modified Conradson carbon content of 6.1% (as measured by the test described on page 521, Vol. II, of *Analytical Methods for Coal and Coal Products*, C. Karr, Jr., Academic Press (1978)). Such decant oils typically possess a nitrogen content of about 0.2 weight percent. Ten grams of the oil was reacted with 200 ml of 70% nitric acid aqueous solution at 25° C. for two hours. After filtration, a solid pitch in a yield of 118%, based on the weight original oil, was obtained. As is discussed above, the yield was more than 100% as some of the nitric acid was incorporated into the product. The pitch product had a Mettler softening point (as determined by ASTM test D 3104-75) of 90° C., a modified Conradson carbon content of 65% and was composed of 5.3 weight percent nitrogen. Infrared analysis, revealed a spectrum having peaks at 6.5 and 7.5 micrometers, thus indicating that this nitrogen was present in the form of nitro-functional groups bound to the aromatic component of the pitch. This infrared spectrum is reproduced in FIG. 1.

Another ten grams decant oil was treated with a 70% nitric acid aqueous solution for three hours at 25° C. The yield of product was 121%, based upon the weight of starting decant oil. The pitch produced possessed a Mettler softening point of 100° C., a modified Conradson carbon content of 61% and was composed of 5.5 weight percent nitrogen.

As a comparison, a sample of identical decant oil was converted to pitch employing a process similar to that disclosed in U.S. Pat. No. 3,140,248 i.e. thermal cracking at 440° C. and 1000 psi followed by vacuum distillation. The yield of pitch produced was 10%. The pitch so produced possessed a Mettler softening point of 132° C. and a modified Conradson carbon value of 51%.

Example 2

An aromatic pyrolysis tar derived from cracking of gas oil for ethylene was nitrated with nitric acid. The liquid tar had an aromatic proton content of 50% as measured by nuclear magnetic resonsance (NMR) and gave a coke yield of 26%, as measured by the modified Conradson carbon content test. The tar (20 grams) was stirred with 400 ml of a 70% aqueous solution of nitric acid for periods of 45 minutes to three hours at 25° C. as indicated in Table I. Reactions were also performed in nitric acid for two hours at 60° C., and at 20° C. using an aqueous acid solution comprised of a 2:1 volume ratio mixture of 70% nitric acid and 98% sulfuric acid. Fresh surfaces of the tar were continually exposed to the acid during the reaction by means of agitation. After reaction the product was collected by vacuum filtration through a fritted glass funnel. The solid product was dried under vacuum. The results and properties of the pitch are shown in Table I. As a comparison, a sample of the pyrolysis tar was converted to a pitch by distillation under vacuum at a pressure of 1 mm and a final liquid temperature of 250° C. The yields of pitch are based on the weight of original tar used. The softening points were determined by the Mettler method, ASTM D 3104-75. The coke yields were determined by the modified Conradson carbon content test.

TABLE I

Nitration of Pyrolysis Tar

| Treatment | Yield of Product %[1] | Softening Point (°C.) | Coke Yield | Total Weight Percent Nitrogen[2] |
|---|---|---|---|---|
| Untreated Tar | — | <25 | 26 | 0.07 |
| (a) $HNO_3$, 25° C. - 45 Minutes | 117 | 109 | 60 | 4.8 |
| (b) $HNO_3$, 25° C. - 1 Hour | 116 | 162 | 63 | 5.2 |
| (c) $HNO_3$, 25° C. - 2 Hours | 123 | 216 | 61 | 5.7 |
| (d) $HNO_3$, 25° C. - 3 Hours | 133 | >250 | 59 | 7.4 |
| (e) 2/1 $HNO_3$ $H_2SO_4$, 25° C. - 2 Hours | 139 | >250 | 54 | 7.4 |
| (f) $HNO_3$, 60° C. - 2 Hours | 158 | >300 | 50 | 8.7 |
| (g) Vacuum Distillation | 62 | 145 | 37 | **[3] |

[1]Based on starting tar.
[2]As determined by elemental analysis.
[3]**indicates not tested.

As can be seen from Table I, the coke yield of the pitch of this invention are greatly increased over conventional vacuum distillation produced pitches. Moreover, the process of this invention produces pitch in greater yields than do vacuum distillation methods.

Example 3

A commercial coal tar, containing 6.2% quinoline insolubles, with a density of 1.21, containing 96% aromatic hydrogen by NMR, and with a modified Conradson carbon value of 29.6%, was treated with a 70 percent nitric acid aqueous solution. A ten-gram sample of tar was stirred with 200 ml of the acid addition for a period of two hours at 25° C. After reaction, a solid pitch product was obtained in a yield of 127% based on the starting tar. The nitrated pitch product had a Mettler softening point of 124° C., a modified Conradson carbon value of 60% and contained 6.6 total weight percent nitrogen. As a comparison, a sample of identical coal tar was heat treated at 250° C. for 3 hours to remove the light components and to obtain a pitch. The yield of pitch was 47% and the pitch had a softening point of 132° C. and a modified Conradson carbon value of 51%.

Example 4

A coal tar identical to that employed in Example 3 was treated as follows. The coal tar was stirred with 70% $HNO_3$ for one hour. The solid product was filtered, ground up, and retreated for another hour with 70% $HNO_3$. The final material obtained in a yield of 129% had a softening point of 159° C., a carbon yield of 57% and contained 7.4 weight percent nitrogen.

Example 5

The nitrated pitches of Examples 2d and 2f (Table I) were used as coking additives to commercial, 108° softening point coal tar pitch. Blends containing 5 and 20 weight percent of each additive were heated to 500° C. in a thermogravimetric analysis (TGA) apparatus, using a nitrogen atmosphere and a heating rate of 5° C./minute. The weight of the carbon residues obtained from the experiments are listed in Table II.

TABLE II

Coke Yields (TGA) at 500° C.

| Material | Coke Yield % |
|---|---|
| Coal Tar Pitch | 50.8 |
| 5% Nitrated Pitch 2d + 95% Coal Tar Pitch | 54.3 |
| 20% Nitrated Pitch 2d + 80% Coal Tar Pitch | 65.0 |
| 5% Nitrated Pitch 2f + 95% Coal Tar Pitch | 55.6 |
| 20% Nitrated Pitch 2f + 80% Coal Tar Pitch | 70.8 |

The above results indicate that the nitrated pitch of this invention may be blended with commercial pitches to enhance the coke yields of such commercial pitches.

What is claimed is:

1. A carbonaceous pitch comprised of an aromatic component characterized in that said pitch further comprises at least 3 weight percent nitrogen in the form of nitro-functional groups which are bound to said aromatic component.

2. The carbonaceous pitch of claim 1 wherein said pitch comprises at least 4 weight percent nitrogen in the form of nitro-functional groups which are bound to said aromatic component.

3. The carbonaceous pitch of claim 1 wherein said pitch possesses a Mettler softening point of between about 75° C. and about 250° C.

4. The carbonaceous pitch of claim 1 wherein said pitch has a modified Conradson coking value of at least about 40 percent.

5. The carbonaceous pitch of claim 4 wherein said pitch has a modified Conradson coking value of at least about 60 percent.

6. A carbonaceous pitch comprised of an aromatic component characterized in that said pitch further comprises at least 3 weight percent nitrogen in the form of nitro-functional groups which are bound to said aromatic component as evidenced by an infrared spectrum having peaks at about 6.5 and about 7.5 microns.

7. A carbonaceous pitch comprised of an aromatic component characterized in that said pitch further comprises at least 3 weight percent nitrogen in the form of nitro-functional groups which are bound to said aromatic component and wherein said pitch possesses a Mettler softening point of between about 75° C. and about 250° C. and has a modified Conradson coking value of at least about 40 percent.

8. The carbonaceous pitch of claim 7 wherein said pitch has an infrared spectrum substantially as shown in FIG. 1.

9. The carbonaceous pitch of claim 7 wherein said pitch has an infrared spectrum having peaks at about 6.5 and about 7.5 microns.

10. A carbonaceous pitch comprised of an aromatic component characterized in that said pitch further comprises at least 4 weight percent nitrogen in the form of nitro-functional groups which are bound to said aromatic component as evidenced by an infrared spectrum having peaks at about 6.5 and about 7.5 microns and wherein said pitch possesses a Mettler softening point of between about 75° C. and about 250° C. and has a modified Conradson coking value of at least about 60 percent.

11. A carbonaceous pitch comprised of an aromatic component characterized in that said pitch further comprises from about 4.8 to about 8.7 weight percent nitrogen in the form of nitro-functional groups which are bound to said aromatic component as evidenced by an infrared spectrum having peaks at about 6.5 and about 7.5 microns and wherein said pitch possesses a Mettler softening point of between about 109° and about 300° C. and has a modified Conradson coking value of between about 50 and 60 percent.

12. A carbonaceous pitch mixture comprising from about 80 to 95 weight percent coal tar pitch and from about 5 to about 20 weight percent nitrated pitch, said nitrated pitch comprising an aromatic component and at least 3 weight percent nitrogen in the form of nitro-functional groups which are bound to said aromatic component, said carbonaceous pitch mixture having a coking yield from about 54 to about 70 percent.

* * * * *